US011391127B1

(12) United States Patent
Hoelscher et al.

(10) Patent No.: US 11,391,127 B1
(45) Date of Patent: Jul. 19, 2022

(54) ADJUSTABLE PERFORATING GUN ORIENTATION SYSTEM

(71) Applicant: Halliburton Energy Services, Inc., Houston, TX (US)

(72) Inventors: Christopher C. Hoelscher, Arlington, TX (US); Camille Anne Bryant, Cleburne, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 30 days.

(21) Appl. No.: 17/139,708

(22) Filed: Dec. 31, 2020

(51) Int. Cl.

| | |
|---|---|
| ***E21B 43/119*** | (2006.01) |
| ***E21B 43/117*** | (2006.01) |
| ***E21B 43/116*** | (2006.01) |
| *E21B 43/11* | (2006.01) |

(52) U.S. Cl.
CPC ..... *E21B 43/119* (2013.01); *E21B 43/116* (2013.01); *E21B 43/117* (2013.01); *E21B 43/11* (2013.01)

(58) Field of Classification Search
CPC .... E21B 43/119; E21B 43/117; E21B 43/116; E21B 43/11
See application file for complete search history.

(56) References Cited

U.S. PATENT DOCUMENTS

| | | | | |
|---|---|---|---|---|
| 6,595,290 | B2 * | 7/2003 | George | E21B 43/119 166/255.2 |
| 7,934,558 | B2 * | 5/2011 | Hales | E21B 43/119 166/50 |
| 8,061,425 | B2 | 11/2011 | Hales et al. | |
| 9,115,572 | B1 * | 8/2015 | Hardesty | E21B 43/117 |
| 9,903,185 | B2 * | 2/2018 | Ursi | E21B 43/119 |
| 11,078,762 | B2 * | 8/2021 | Mauldin | E21B 43/119 |
| 2003/0098158 | A1 | 5/2003 | George et al. | |
| 2003/0188867 | A1 | 10/2003 | Parrott et al. | |

(Continued)

FOREIGN PATENT DOCUMENTS

| | | |
|---|---|---|
| CN | 209179739 U | 7/2019 |
| WO | 2019-168938 | 9/2019 |

OTHER PUBLICATIONS

Owens—Zero180 product line, Available at https://www.corelab.com/owen/gunsystems-zero180, Accessed Dec. 30, 2020.

(Continued)

*Primary Examiner* — Yong-Suk (Philip) Ro
(74) *Attorney, Agent, or Firm* — John Wustenberg; C. Tumey Law Group PLLC

(57) ABSTRACT

A perforating gun system may include a gun body and a charge tube disposed within and rotatably mounted to the gun body, wherein the charge tube includes a receiving feature disposed at an axial end of the charge tube. The perforating gun system may also include at least one charge mounted within the charge tube. The at least one charge is configured to perforate a sidewall of a wellbore upon detonation. Additionally, perforating gun system may include a weighted feature adjustably attached to the receiving feature of the charge tube in one of a plurality of angular positions, wherein adjusting the angular position of the weighted feature is configured to adjust a center of gravity of the charge tube such that gravity will cause the charge tube to rotate to a corresponding phasing angle.

20 Claims, 4 Drawing Sheets

(56) References Cited

U.S. PATENT DOCUMENTS

| | | | | |
|---|---|---|---|---|
| 2006/0075889 | A1* | 4/2006 | Walker | E21B 43/117 102/320 |
| 2008/0011483 | A1 | 1/2008 | LaGrange et al. | |
| 2009/0151588 | A1* | 6/2009 | Burleson | E21B 43/119 175/4.53 |
| 2016/0208587 | A1 | 7/2016 | Hardesty et al. | |
| 2017/0175500 | A1 | 6/2017 | Robey et al. | |

OTHER PUBLICATIONS

Halliburton, Perforating Solutions, Data Sheet: G-Force System Enable Perforating in any Direction, 2011, available at https://www.halliburton.com/content/dam/ps/public/lp/contents/Data_Sheets/web/H/H08597.pdf.

WP—Velocity product line, Available at https://www.halliburton.com/en-US/ps/wireline-perforating/wireline-and-perforating/perforating-services/velocity-perforating-system.html, Accessed Dec. 30, 2020.

International Search Report and Written Opinion for Application No. PCT/US2021/012581, dated Sep. 9, 2021.

* cited by examiner

ADJUSTABLE PERFORATING GUN ORIENTATION SYSTEM

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. Traditionally the casing string is cemented to the wellbore. To access the hydrocarbons for production, a perforating gun system may be deployed into the casing string via a tool string. The tool string (e.g., a tubing string, wireline, slick line, coil tubing) lowers the perforating gun system into the casing string to a desired position within the wellbore. Once the perforating gun system is in position such that shaped charges are disposed adjacent to a subterranean formation having hydrocarbons, the shaped charges are detonated. The detonation perforates the casing string, the cementing, and the subterranean formation such that hydrocarbons may flow into the casing string via the perforation.

Some perforating gun systems are configured to aim the shaped charges in particular directions to improve production and/or avoid particular portions of the subterranean formation. Indeed, some perforating gun systems are configured to dynamically adjust an orientation of the shaped charges. That is a rotating member holding the shaped charges is configured to rotate within the perforating gun due to gravitational forces based on a center gravity of the rotating member. To aim the shaped charges in particular directions, the shaped charges and/or portions of the rotating members are configured (e.g., positioned, adjusted, etc.) before installing the rotating member in the perforating gun, such that the dynamical adjustment moves the shaped charges into desired orientations within the wellbore.

However, in these traditional systems, re-positioning and/or adjusting the shaped charges to modify the orientations of the shaped charges within the wellbore after initial installation requires disassembly of the perforating guns. That is, the rotating members and other perforating gun components must be removed from the perforating gun bodies to provide access to re-position and/or adjust the shaped charge holders, replace the rotating member, etc. Unfortunately, removing rotating members and other perforating gun components to adjust the orientations of the shaped charges is costly, time consuming, and may hinder efficiency of production operations.

BRIEF DESCRIPTION OF THE DRAWINGS

These drawings illustrate certain aspects of some of the embodiments of the present disclosure and should not be used to limit or define the method.

DETAILED DESCRIPTION

Provided are systems for perforating a subterranean formation and, more particularly, example embodiments may include a perforating gun system configured to dynamically adjust an orientation of a charge tube, via gravitational forces, such that shaped charges in the perforating gun system shoot in desired directions upon detonation. Without disassembling the perforating gun system, a perforating gun system may be configured modify a center of gravity of the charge tube, to change a resting orientation of the charge tube resulting from the dynamical adjustment of the charge tube. In particular, the perforating gun system may be configured to modify the center of gravity of the charge tube while the charge tube is disposed within and rotatably mounted to a gun body of the perforating gun system.

Figure 1:
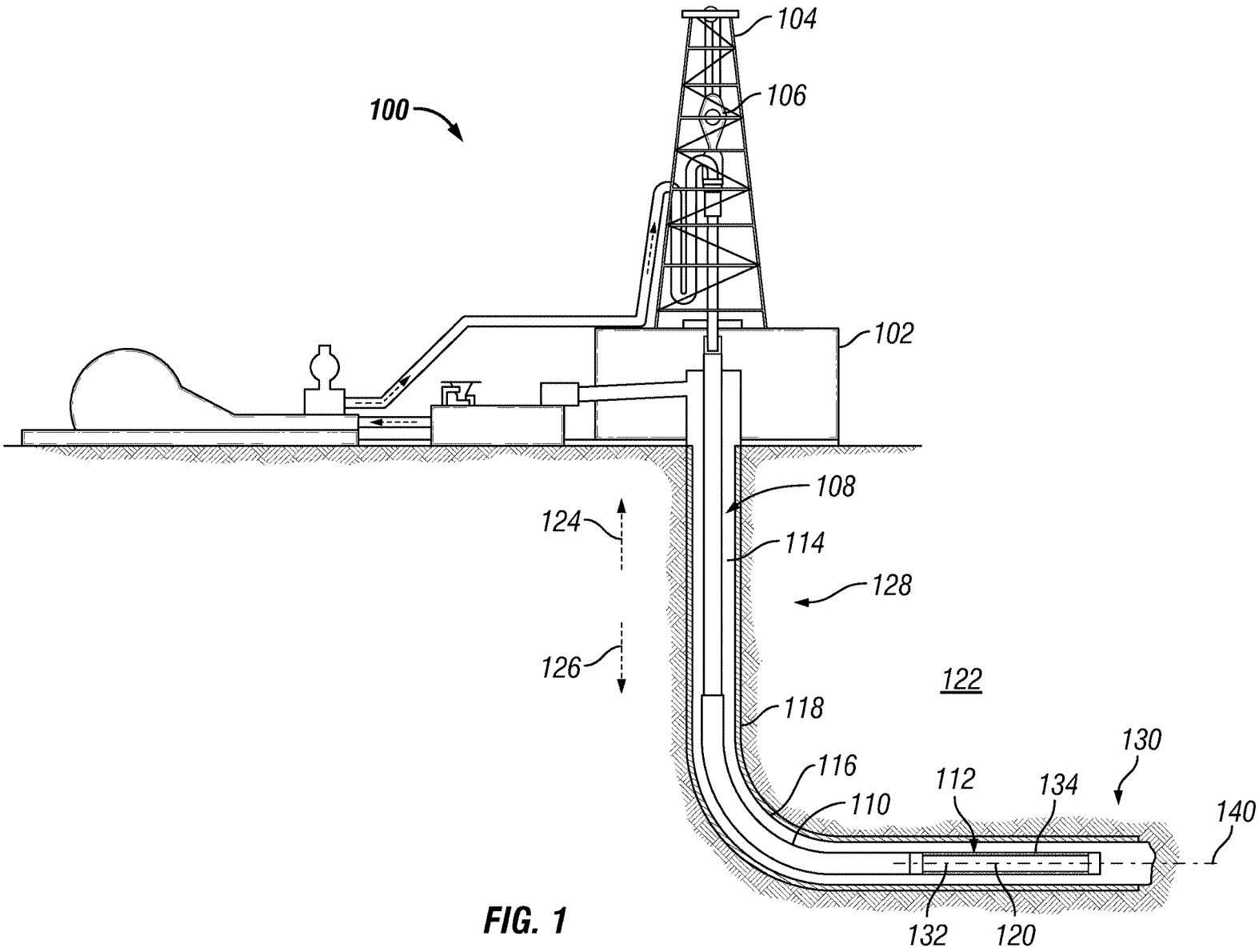
FIG. 1 illustrates a side elevation, partial cross-sectional view of an operational environment for a drilling system in accordance with one or more embodiments of the disclosure.

FIG. 1 illustrates a side elevation, partial cross-sectional view of an operational environment for a drilling and completion system in accordance with one or more embodiments of the disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure. As illustrated, the drilling and completion assembly 100 includes a platform 102 that supports a derrick 104 having a traveling block 106 for raising and lowering a tool string 108. The tool string 108 includes, but is not limited to, a work string 110, a perforating gun system 112, and any other suitable tools, as generally known to those skilled in the art. While not shown, tubing string, wireline, slick line, and/or coil tubing may be used instead of convention work string 110 for supporting the perforating gun system 112.

The work string 110 is configured to lower the perforating gun system 112 into a wellbore 114. As illustrated, the wellbore 114 may be lined with casing 116 cemented to a wellbore wall 118. The casing 116 is configured to protect the wellbore 114 from failure (e.g., collapse, erosion) and to provide a fluid path for hydrocarbons during production. To access the hydrocarbons, the work string 110 lowers the perforating gun system 112 to a position such that shaped charges 120 are disposed adjacent to a subterranean formation 122 having the hydrocarbons, and the perforating gun system 112 detonates the shaped charges 120. In some embodiments, the shaped charges 120 may be sequentially detonated by the perforating gun system 112 in a downhole to uphole direction 124 or an uphole to downhole direction 126. The detonations perforate the casing 116, the cementing, and the subterranean formation 122 in the respective paths of the shaped charge detonations such that hydrocarbons may flow into the casing 116 string via the perforations.

In the illustrated embodiment, the wellbore 114 has a vertical portion 128 and a horizontal portion 130 with the perforating gun system 112 being disposed in the horizontal portion 130. The perforating gun system 112 includes a charge tube 132 (e.g., a rotating member holding the shaped charges 120) rotatably mounted within a gun body 134 of the perforating gun system 112. As set forth in greater detail below, the perforating gun system 112 is configured to dynamically adjust the orientation of a charge tube 132 to the resting orientation 136 based on a center of gravity 138 of a charge tube 132 (shown in FIG. 2A). That is, with the perforating gun system 112 disposed in the horizontal portion 130 of the wellbore 114, the charge tube 132 is biased by gravity to rotate (e.g., dynamically adjusted) until the center of gravity 138 of the charge tube 132 is disposed directly below a rotational axis 140 of the charge tube 132 (e.g., the resting orientation 136). Although the illustrated embodiment shows the perforating gun system 112 disposed in the horizontal portion 130, the perforating gun system 112 may be configured to dynamically adjust the orientations of the shaped charges 120 in any non-vertical portion of the wellbore 114.

Figure 2B:
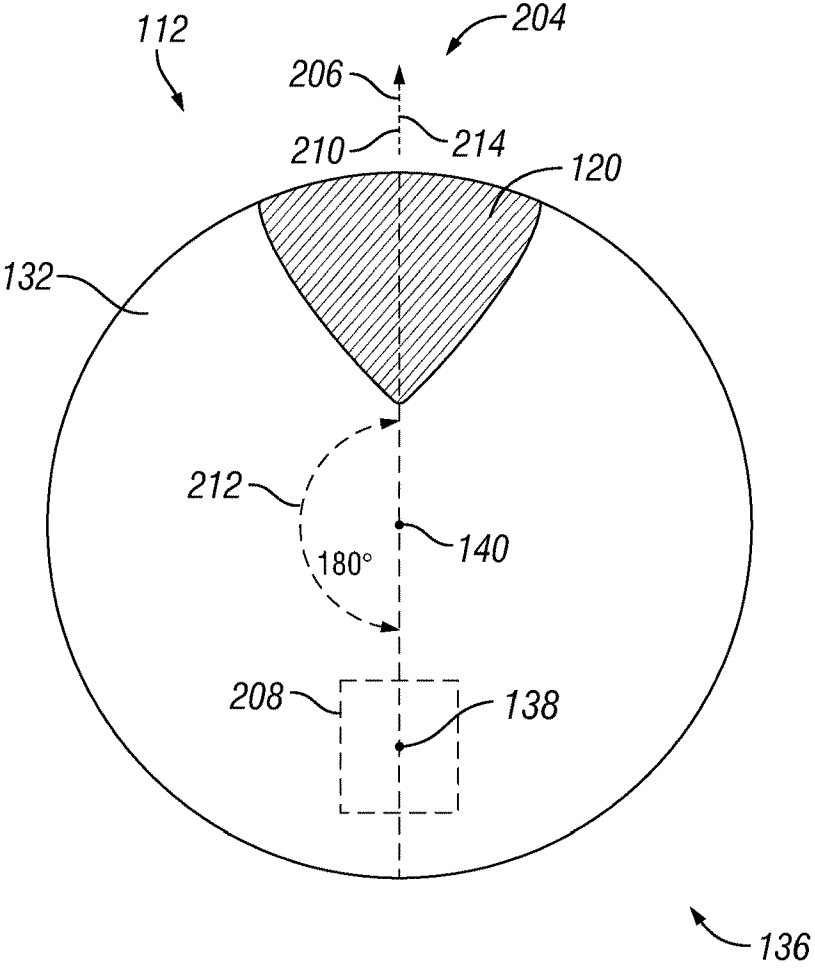
FIGS. 2A and 2B illustrate respective cross-sectional views of the charge tube of the perforating gun system, in accordance with one or more embodiments of the disclosure.
Figure 2A:
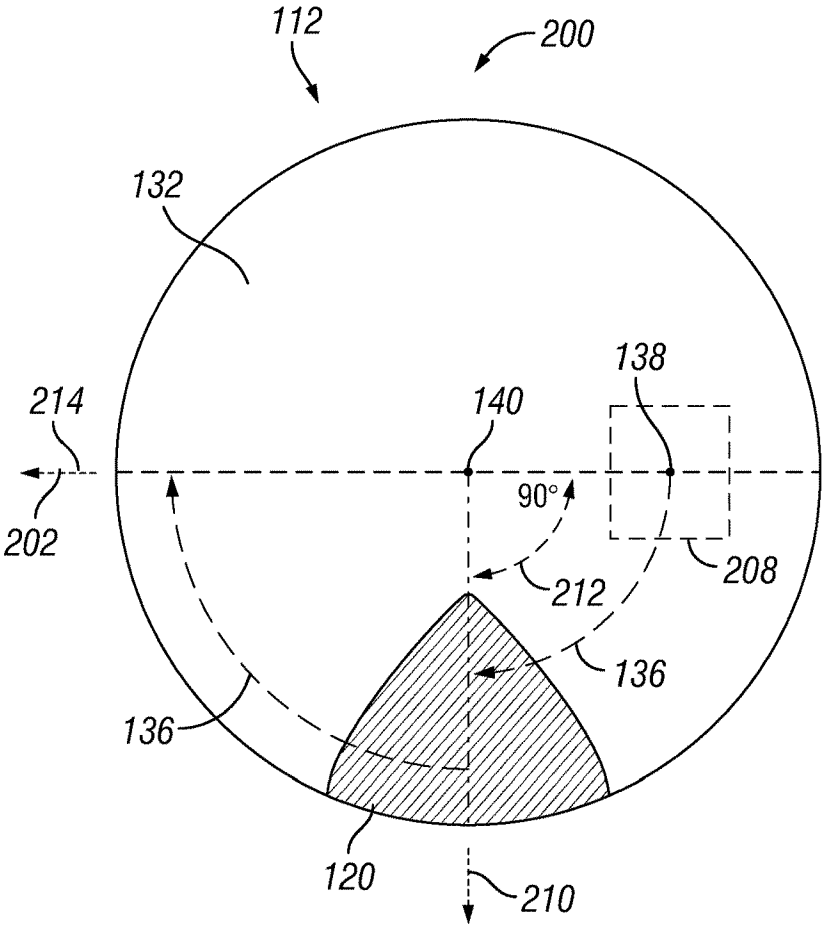

FIGS. 2A and 2B illustrate respective cross-sectional views of the charge tube 132 of the perforating gun system 112, in accordance with one or more embodiments of the disclosure. In some embodiments, the shaped charges 120 are fixed to the charge tube 132. Thus, to aim the shaped charges 120 in desired directions 214 (i.e., move the shaped charges 120 into desired orientations with respect to the wellbore 114) the perforating gun system 112 is configured to modify the center of gravity 138 of the charge tube 132 to change the resting orientation 136 of the charge tube 132 resulting from the dynamical adjustment (e.g., biasing the charge tube 132 via gravity to rotate about the rotational axis 140 until the center of gravity 138 is disposed directly below the rotational axis 140 of the charge tube 132). As the shaped charges 120 are fixed to the charge tube 132, changing the resting orientation 136 of the charge tube 132 moves the orientation of the shaped charges 120 with respect to the wellbore 114. For example, in a first position 200 shown in FIG. 2A, the center of gravity 138 of the charge tube 132 may be disposed ninety degrees counter-clockwise from the shaped charge 120 such that the shaped charge 120 will be directed in a lateral left direction 202 when the charge tube 132 dynamically adjusts from the shown orientation to the resting orientation 136 with the center of gravity 138 disposed directly below the rotational axis 140 of the charge tube 132. In a second position 204 shown in FIG. 2B, the center of gravity 138 of the charge tube 132 may be adjusted such that it is disposed one-hundred and eighty degrees counter-clockwise from the shaped charge 120 such that the shaped charge 120 is directed in an upward direction 206 when the charge tube 132 is in the resting orientation 136. Thus, the perforating gun system 112 is configured to aim the shaped charges 120 in the desired directions 214 by selectively adjusting the center of gravity 138 of the charge tube 132 with respect to the shaped charges 120.

In some embodiments, the perforating gun system 112 includes a weighted feature 208 configured to adjust the center of gravity 138 of the charge tube 132. That is, the additional mass from the weighted feature 208 is configured to change the center of gravity 138 (e.g., center of mass) of the charge tube 132 based on a position of the weighted feature 208 with respect to the charge tube 132. The weighted feature 208 may be rigidly attached to the charge tube 132 to add mass to a particular portion of the charge tube 132. Attaching the weighted feature 208 to the charge tube 132 at a particular position may aim the shaped charge 120 in a corresponding direction. Indeed, an aimed direction 210 of the shaped charge 120 is based at least in part on an angular orientation of the shaped charge 120 with respect to the center of gravity 138 of the charge tube 132. As such, selectively adjusting the angular orientation 212 of the weighted feature 208 with respect to the shaped charge 120 may move the aimed direction 210 of the shaped charge 120 to the desired direction 214.

In some embodiments, the weighted feature 208 is attached to a radially outward portion of the charge tube 132 proximate an outer diameter of the charge tube 132. A radial positioning of the weighted feature 208 may affect a radial position of the center of gravity 138 of the charge tube 132. Positioning the weighted feature 208 on the charge tube 132 to move the center of gravity 138 radially outward may increase the moment arm, which may increase the moment (e.g., torque) on the charge tube 132 for rotating the charge tube 132 to the resting orientation 136. The weighted feature 208 may be positioned to generate more torque to overcome forces (e.g., friction, etc.) resisting rotation of the charge tube 132 with respect to the gun body 134. Additionally, or alternatively, the mass of the weighted feature 208 may be increased to increase the torque on the charge tube 132.

Moreover, the weighted feature 208 is configured to removably attached to the charge tube 132 such that the weighted feature 208 may be moved to various positions on the charge tube 132. As set forth above, moving the weighted feature 208 adjust the center of gravity 138 of the charge tube 132 to aim the shaped charges 120 in the desired direction 214.

Figure 3:
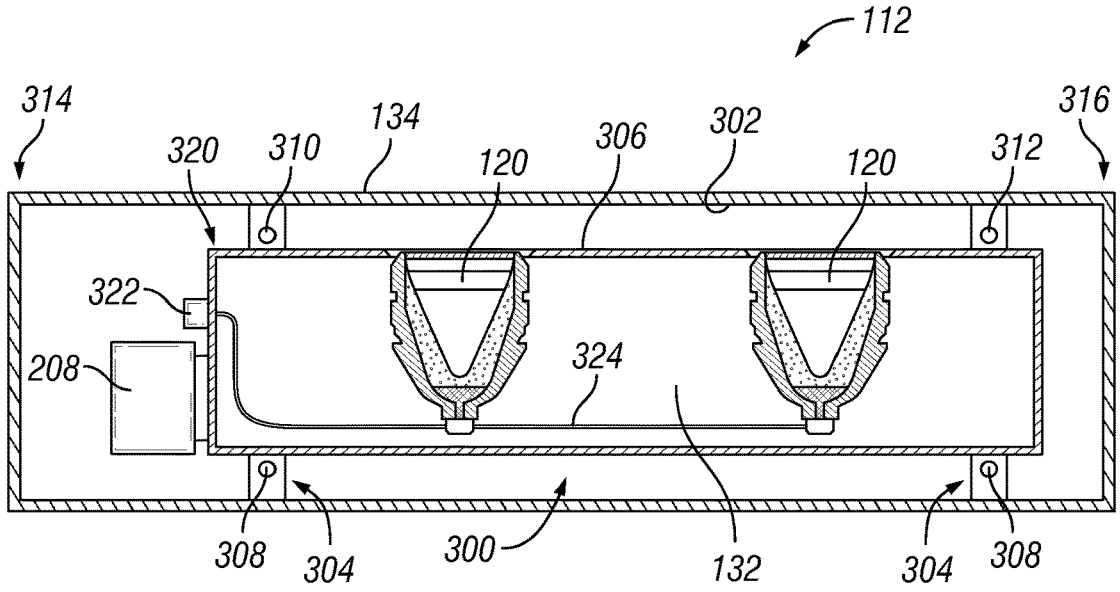
FIG. 3 illustrates a cross-sectional view of the perforating gun system, in accordance with some embodiments of the present disclosure.

FIG. 3 illustrates a cross-sectional view of the perforating gun system 112, in accordance with some embodiments of the present disclosure. As set forth above, the perforating gun system 112 includes the gun body 134 (e.g. gun carrier). The gun body 134 is configured to house the charge tube 132. In the illustrated embodiment, the charge tube 132 includes a generally cylindrical shape. However, the charge tube 132 may include any suitable shape that permits free rotation of the charge tube 132 within an interior portion 300 of gun body 134. For example, the charge tube 132 may include an elliptical profile so long as the charge tube 132 may freely rotate within the gun body 134 without contacting an interior surface 302 of the gun body 134. Contact between the charge tube 132 and gun body 134 may hinder or prevent rotation of the charge tube 132.

In some embodiment, the perforating gun system 112 may include a plurality of mounting devices 304 configured to rotatably mount the charge tube 132 within the gun body 134. The mounting devices 304 may radially secure the charge tube 132 within the gun body 134 to prevent the exterior surface 306 of the charge tube 132 from contacting the interior surface 302 of the gun body 134. Further, the mounting devices 304 may include roller elements or bearings 308 configured to permit free rotation of the charge tube 132 with respect to the gun body 134. The bearings 308 may include ball bearings, roller bearings, plain bearings, or any other suitable type of bearing. In the illustrated embodiment, the plurality of bearings 308 include a first set of bearings 310 secured to an interior portion 300 of the gun body 134 proximate a first axial end 314 of the gun body 134 and a second set of bearings 312 secured to the interior portion 300 of the gun body 134 proximate the second axial end 316 of the gun body 134. In some embodiment, the perforating gun system 112 may include additional mounting devices 304 to further secure the charge tube 132. For example, the perforating gun system 112 may include thrust bearings configured to axially secure the charge tube 132 with respect to the gun body 134.

As set forth above, the perforating gun system 112 includes the weighted feature 208 configured to adjust the center of gravity 138 of the charge tube 132. In the illustrated embodiment, the weighted feature 208 is disposed between a first axial end 320 of the charge tube 132 and the first axial end 314 of the gun body 134. Positioning the weighted feature 208 between the first axial end 320 of the charge tube 132 and the first axial end 314 of the gun body 134 may provide access to the weighted feature 208 via the first axial end 314 of the gun body 134. As set forth in more detail below, the positioning (e.g., angular orientation 212 and/or radial position) of the weighted feature 208 with respect to the charge tube 132 may be adjusted from the first axial end 314 of the gun body 134. That is, to adjust the weighted feature 208, the first axial end 314 of the charge tube 132 may be removed such that the weighted feature 208 may be re-positioned while the charge tube 132 is disposed within the gun body 134. In some embodiments, the weighted feature 208 may be re-positioned without removing the first axial end 314 of the gun body 134. In some embodiments, the weighted feature 208 is disposed at least partially radially outward from the charge tube 132 along a portion of the charge tube 132. The weighted feature 208 may be positioned in any suitable position with respect to the charge tube 132 such that the weighted feature 208 may be re-positioned without removing the charge tube 132 from the gun body 134.

Moreover, the perforating gun system 112 also includes the at least one shaped charge 120. As set forth above, the shaped charge 120 may be mounted within the charge tube 132. The at least one shaped charge 120 is configured to detonate to perforate the casing 116, the cementing, and the subterranean formation 122. The perforating gun system 112 further includes a detonating device 322 configured to initiate detonation of the shaped charges 120. The detonating device 322 may include a detonating cord 324 connected to each shaped charge 120 mounted within the charge tube 132.

Figure 4:
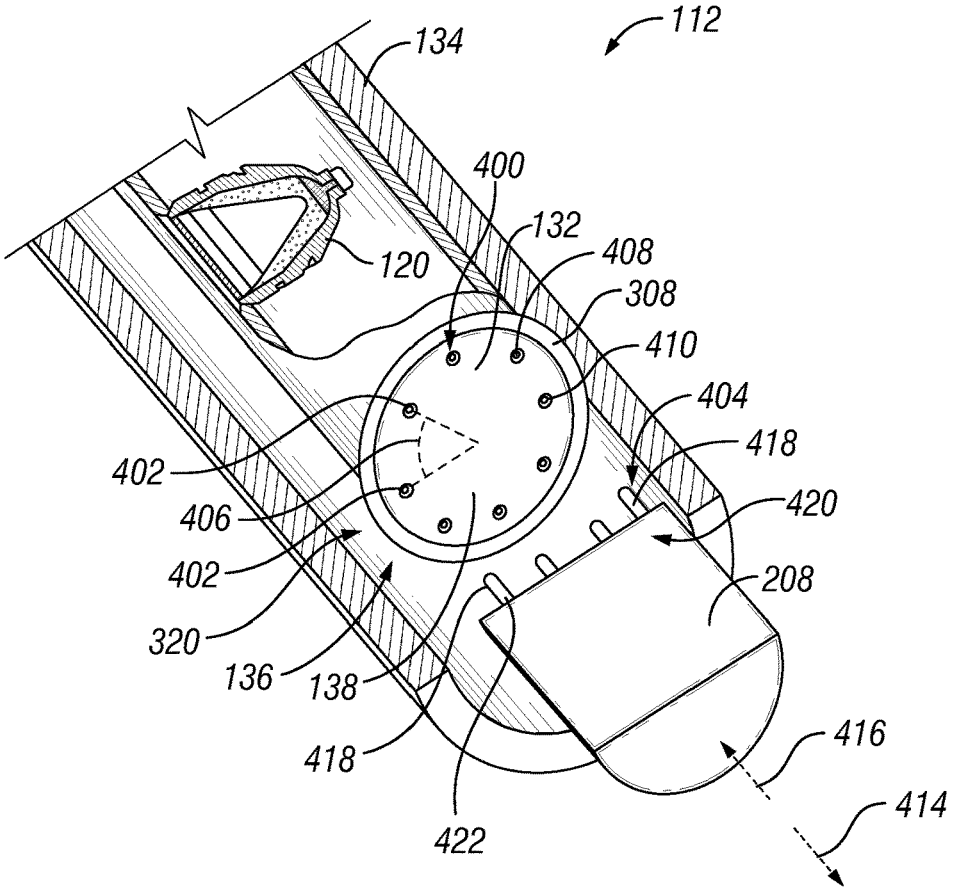
FIG. 4 illustrates a perspective view of the weighted feature secured to the charge tube of the perforating gun system, in accordance with some embodiments of the present disclosure.

FIG. 4 illustrates a perspective view of the weighted feature 208 configured to secure to the charge tube 132 of the perforating gun system 112, in accordance with some embodiments of the present disclosure. As set forth above, the charge tube 132 is disposed within and rotatably mounted to the gun body 134 via the plurality of bearings 308. The charge tube 132 has at least one shaped charge 120. Further, the perforating gun system 112 includes the weighted feature 208 that may be removably or adjustably attached to the charge tube 132 in one of a plurality of angular orientations. The weighted feature 208 may be re-positioned to adjust the center of gravity 138 of the charge tube 132 such that gravity will cause the charge tube 132 to rotate to a corresponding phasing angle (e.g., resting orientation 136).

In some embodiments, the charge tube 132 includes a receiving feature 400 disposed at the first axial end 320 of the charge tube 132. In the illustrated embodiment, the receiving feature 400 includes a plurality of axial slots 402 disposed in a circular pattern around the first axial end 320 of the charge tube 132. However, the receiving feature 400 may include any suitable feature configured to receive a corresponding attachment feature 404. The axial slots 402 may be angularly offset 406 by a particular angle. For example, the axial slots 402 may be angularly offset 406 from each other by forty-five degrees such that the receiving feature 400 includes a set of eight axial slots 402 angularly offset 406 from each other around the axial end of the charge tube 132. However, the receiving feature 400 may include any number of axial slots 402. Further, in some embodiments, the axial slots 402 of the receiving feature 400 may be radially offset (not shown) from each other. Moreover, each axial slot 402 may include a circular bore 408 in the first axial end 320 of the charge tube 132. Alternatively, the axial slots 402 may include other bores with alternative shapes (e.g., rectangular, hexagonal, star, cross, etc.). Further, each axial slot 402 of the receiving feature 400 may include a lip feature 410 configured to secure the attachment feature 404 within the respective axial slot 402. For example, the lip feature 410 may be configured to provide a snap-fit between the receiving feature 400 and the attachment feature 404. In some embodiments, the axial slots 402 may be tapped such that they are configured to receive corresponding threaded portions of the attachment feature 404.

The attachment feature 404 may be mounted to the weighted feature 208 and configured to interface with the receiving feature 400 to adjustably attach to the receiving feature 400. The attachment feature 404 may be configured to disengage from the receiving feature 400 in a first angular position and re-engage with the receiving feature 400 in another angular position (e.g., a second angular position) to adjust the angular orientation of the weighted feature 208 with respect to the charge tube 132. As set forth above, the attachment feature 404 may be configured disengage and re-engage with the receiving feature 400 while the charge tube 132 is disposed within and rotatably mounted to the gun body 134. To disengage the attachment feature 404, an axial force may be applied to the weighted feature 208 and/or attachment feature 404 in an axial outward direction 414 away from the charge tube 132 and/or receiving feature 400. In some embodiments, a tool may be secured to the weighted feature 208 to apply the axial force. However, the snap-fit may be configured such that the attachment feature 404 may be disengaged via an operator manually pulling on the weighted feature 208 and/or attachment feature 404. To re-engage the attachment feature 404, the weighted feature 208 may be aligned to the desired angular orientation 212 and an axial force may be applied to the weighted feature 208 and/or attachment feature 404 in an axial inward direction 416 toward the charge tube 132.

In the illustrated embodiment, the attachment feature 404 includes a plurality of pins 418 mounted to an axially inner end 420 of the weighted feature 208. In some embodiments, the pins 418 may be welded, brazed, threaded, or otherwise fastened to the weighted feature 208. Alternatively, the plurality of pins 418 may be integral to the weighted feature 208. That is, the weighted feature 208 may be cast to have the plurality of pins 418, the plurality of pins 418 may be machined into the axial inner end 420 of the weighted feature 208, etc. Moreover, as set forth above, the plurality of pins 418 may be configured to interface with the plurality of axial slots 402 of the receiving feature 400 to secure the weighted feature 208 to the charge tube 132 at a particular angular orientation 212. In the illustrated embodiment, the pins 418 are cylindrically shaped to interface with corresponding cylindrical, axial slots 402 of the receiving system. However, the pins 418 may include any suitable shaped configured to interface with the plurality of axial slots 402 of the receiving system. Moreover, the plurality of pins 418 may include recessed portions configured to interface with the lip feature 410 such that the plurality of pins 418 may snap-fit within the axial slots 402 of the receiving feature 400.

The plurality of pins 418 may be disposed in a similar pattern, with respect to the axial slots 402, around at least a portion of the axial inner end 420 of the weighted feature 208. Further, the plurality of pins 418 may include a same angular offset and/or radial offset between pins 418 as with the plurality of axial slots 402. Alternatively, the pins 418 may be angularly offset from each other by a multiplicative angle with respect to the offset angle of the plurality of axial slots 402. For example, the plurality of pins 418 may be offset from each other by substantially ninety degrees in an embodiment having the plurality of axial slots 402 offset by forty-five degrees. As such, a first pin 422 of the plurality of pins 418 may be engage in any of the plurality of axial slots 402 of the receiving feature 400 as the remaining pins 418 may always align with other axial slots 402 of the receiving feature 400 when the first pin 422 is engaged. Accordingly, the angular orientation of the weighted feature 208 may be adjusted with respect to the charge tube 132 by indexing the pins 418 with respect to the axial slots 402. For example, the plurality of axial slots 402 may be offset from each other by forty-five degrees. Thus, indexing the pins 418 to adjacent axial slots 402 in a counterclockwise direction may rotate the weighted feature 208 forty-five degrees with respect to the charge tube 132. The receiving feature 400 may include additional axial slots 402 to increase the resolution for adjusting the weighted feature 208 with respect to the charge tube 132.

Moreover, in the illustrated embodiment, the weighted feature 208 includes a semi-cylindrical shape. However, the weighted feature 208 may include any suitable shape having a center of mass that is radially offset from the rotational axis 140 of the charge tube 132 when attached. Further, the weighted feature 208 may include a steel material. Alternatively, the weighted feature 208 may include any suitable material (e.g., lead, tungsten, etc.) having sufficient weight for effectively adjusting the center of gravity 138 of the charge tube 132.

Figure 5:
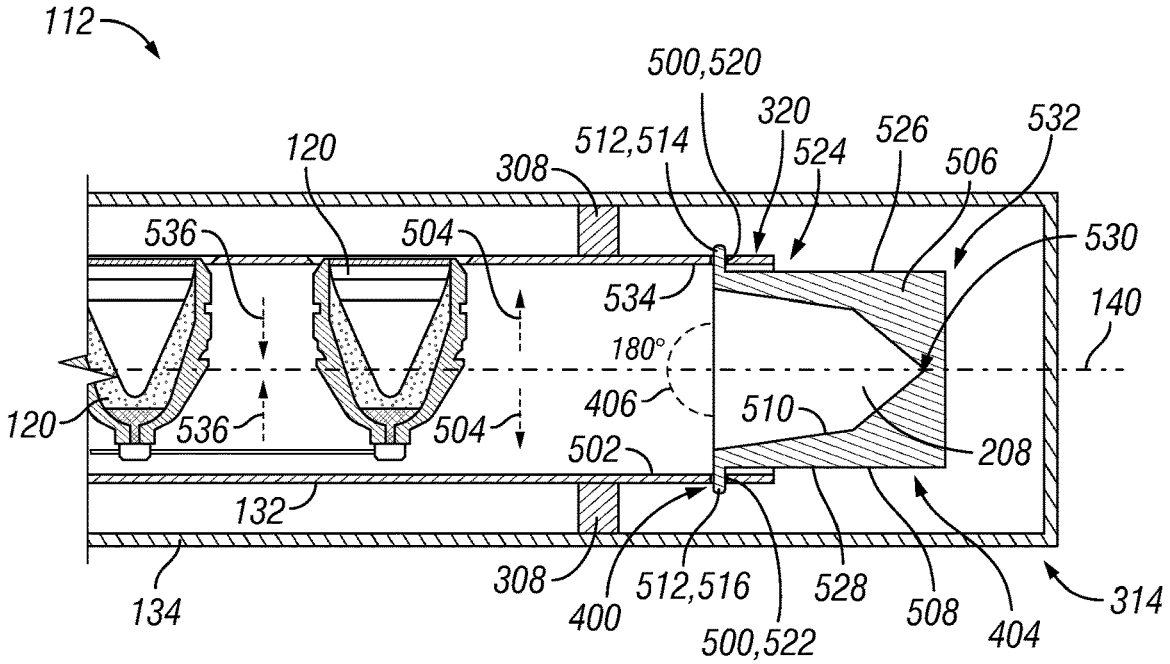
FIG. 5 illustrates a cross-sectional view of a compliant housing for securing the weighted feature to the charge tube, in accordance with some embodiments of the present disclosure.

FIG. 5 illustrates a cross-sectional view of a compliant housing for securing the weighted feature 208 to the charge tube 132, in accordance with some embodiments of the present disclosure. As set forth above, the perforating gun system 112 includes the charge tube 132 that is configured to house shaped charges 120, disposed within the gun body 134, and rotatably mounted to the gun body 134 via bearings 308. Further, the charge tube 132 may include the receiving feature 400 configured to receive the attachment feature 404 such that the weighted feature 208 may removably or adjustably attach the to the charge tube 132.

In the illustrated embodiment, the receiving feature 400 includes plurality of radial slots 500 disposed proximate the first axial end 320 of the charge tube 132. The radial slots 500 may extend at least partially into an outer wall 502 of the charge tube 132 in a substantially radially outward direction 504. In some embodiments, the radial slots 500 may extend through the outer wall 502 of the charge tube 132. The radial slots 500 may be disposed in a circular pattern around an inner surface 506 of the outer wall 502 proximate the first axial end 320 of the charge tube 132. The radial slots 500 may be angularly offset from each other by a particular angle. For example, the radial slots 500 may be angularly offset from each other by forty-five degrees such that the receiving feature 400 includes a set of eight radial slots 500 angularly offset from each other around the inner surface 506 of the outer wall 502 of the charge tube 132. In some embodiments, the receiving feature 400 includes an even number of slots, with each radial slot 500 having a corresponding radial slot angularly offset 406 by one-hundred and eighty degrees. However, the receiving feature 400 may include any number of radial slots 500. Further, in some embodiments, the radial slots 500 of the receiving feature 400 may be axially offset from each other (not shown) such that the position of the weighted feature 208 may be axially adjusted within the gun body 134. Moreover, each radial slot 500 may include a circular bore configured to receive a corresponding attachment feature 404. Alternatively, the radial slots 500 may include alternative bore shapes (e.g., rectangular, hexagonal, star, cross, etc.).

As illustrated, the attachment feature 404 may include a compliant housing 506 secured to the weighted feature 208. In some embodiments, the weighted feature 208 may be attached to an exterior portion 508 of the compliant housing 506. Alternatively, the weighted feature 208 may be housed within an interior portion 510 of the compliant housing 506. The compliant housing 506 is configured to mount to the receiving feature 400 to removably or adjustably attach the weighted feature 208 to the charge tube 132. In the illustrated embodiment, the compliant housing 506 includes a plurality of radial pins 512 (e.g., a first radial pin 514 and a second radial pin 516) configured to interface with the radial slots 500 of the receiving feature 400 to secure the weighted feature 208 to the charge tube 132 at a particular angular orientation with respect to the charge tube 132. The plurality of radial pins 512 may extend from the compliant housing 506 in the radially outward direction 504 with respect to the rotational axis 140 of the charge tube 132. At least an end portion 518 of each of the radial pins 512 may include a substantially cylindrical shape configured to interface with corresponding cylindrical, radial slots 500 (e.g., a first radial slot 520 and a second radial slot 522) of the receiving feature 400. However, the plurality of radial pins 512 may include any suitable shapes configured to interface with the plurality of radial slots 500 of the receiving feature 400.

Moreover, the plurality of radial pins 512 may be disposed at a first end 524 of the compliant housing 506. The plurality of radial pins 512 may include the first radial pin 514 angularly offset 406 from the second radial pin 516 by substantially one hundred and eighty degrees such that the first radial pin 514 and the second radial pin 516 are disposed on opposing sides (e.g., a first radial side 526 and a second radial side 528) of the first end 524 of the compliant housing 506. The sides of the compliant housing 506 may be connected via a flexible portion 530 of the compliant housing 506. In the illustrated embodiment, the flexible portion 530 is disposed proximate a second end 532 of the compliant housing 506. The flexible portion 530 is configured to deflect such that the first radial side 526 and the second radial side 528 move radially inwards towards each other. Applying a radial force to the first radial side 526 and the second radial side 528 of the compliant housing 506 may deflect the flexible portion 530. In some embodiments, an operator may squeeze the compliant housing 506 by hand or with a tool to deflect the flexible portion 530. The compliant housing 506 is accessible via the first axial end 314 of the gun body 134 such that the flexible portion 530 may be deflected while the charge tube 132 is disposed within the gun body 134. Indeed, the compliant housing 506 and weighted feature 208 may be disposed at least partially between the first axial end 320 of the charge tube 132 and the first axial end 314 of the gun body 134 such that the compliant housing 506 is accessible via the first axial end 314 of the gun body 134.

To adjust or re-position the weighted feature 208, the axial force may be applied to portions of the first radial side 526 and the second radial side 528 of the compliant housing 506 extending out of the charge tube 132 to deflect the flexible portion 530 and retract the first radial pin 512 and the second radial pin 516 away from an inner surface 534 of the outer wall 502 of charge tube 132 in a radially inward direction 536. Then, the compliant housing 506 may be rotated with respect to the charge tube 132 to a desired angular orientation. When the weighted feature 208 is disposed at the desired angular orientation 212 with respect to the charge tube 132, the axial force may be released; thereby, releasing the flexible portion 530 to drive the radial pins 512 in the radially outward direction 504 and re-engage the radial pins 512 with the radial slots 500 corresponding to the desired angular orientation 212 of the weighted feature 208 with respect to the charge tube 132.

The receiving feature 400 may include any number of corresponding radial slots 500 to receive the radial pins 512. The receiving feature 400 may include additional radial slots 500 to increase the resolution for adjusting the angular orientation 212 of the weighted feature 208 with respect to the charge tube 132. As set forth above, adjusting the angular orientation 212 of the weighted feature 208 is configured to adjust a center of gravity 138 of the charge tube 132 such that gravity will cause the charge tube 132 to rotate to a corresponding phasing angle (e.g., resting orientation).

Figure 6:
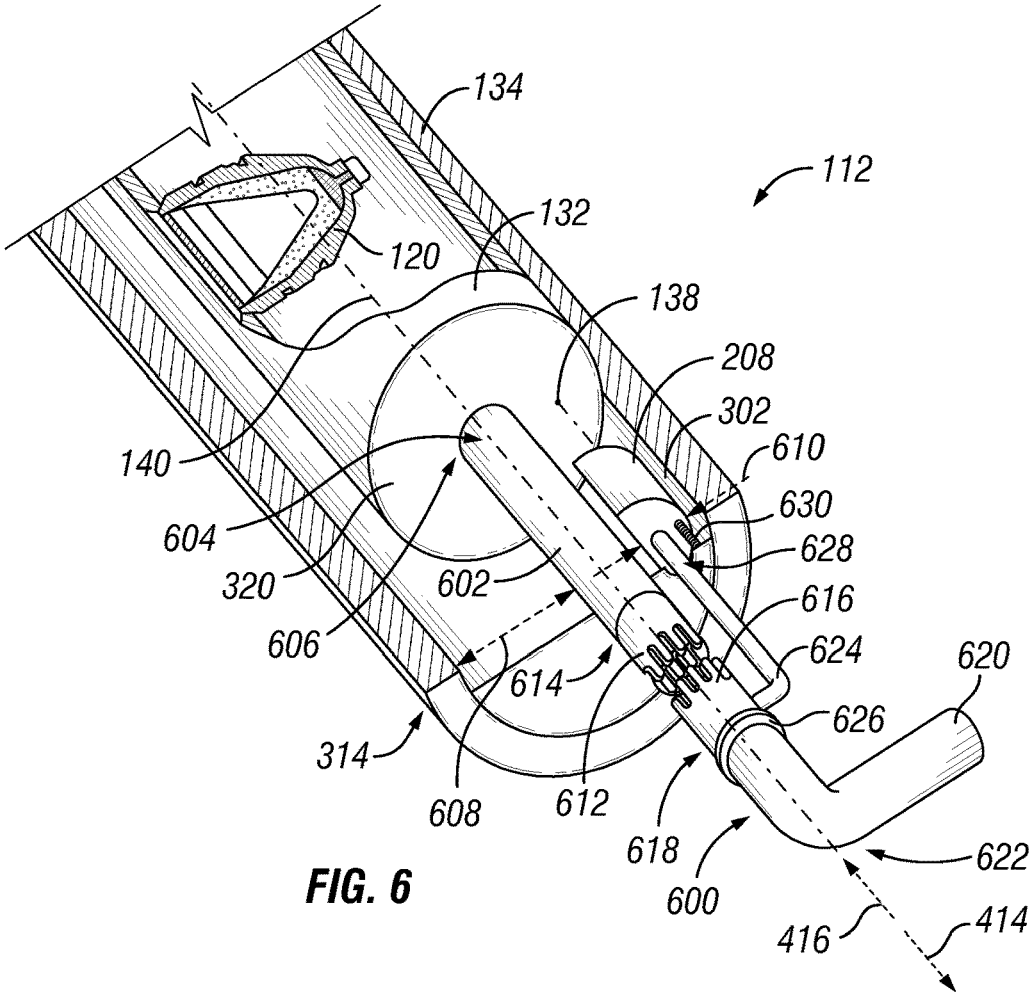
FIG. 6 illustrates a perspective view of an adjustment arm for adjusting the angular orientation of the weighted feature, in accordance with some embodiments of the present disclosure.

FIG. 6 illustrates a perspective view of an adjustment arm 600 for adjusting the angular orientation of the weighted feature 208, in accordance with some embodiments of the present disclosure. As set forth above, the perforating gun system 112 includes the charge tube 132 configured to house shaped charges 120. Further, the charge tube 132 is disposed within the gun body 134 and is rotatably mounted to the gun body 134.

In the illustrated embodiment, the perforating gun system 112 also includes an anchor arm 602 extending out from the first axial end 320 of the charge tube 132. As illustrated, the anchor arm 602 may include a cylindrical shape, or any other suitable shape. A proximal end 604 of the anchor arm 602 may be integral with or fastened to (e.g., welded, brazed, threaded, etc.) the first axial end 320 of the charge tube 132. The anchor arm 602 may extend out from a central portion 606 of the first axial end 320 of the charge tube 132. In the illustrated embodiment, the anchor arm 602 extends out from the first axial end 320 along the rotational axis 140 of the charge tube 132. However, the anchor arm 602 may extend out from any suitable portion of the first axial end 320 of the charge tube 132 that provides a sufficient radial gap 608 between the anchor arm 602 and the interior surface 302 of the gun body 134. As set forth in detail below, the weighted feature 208 is configured to rotate around the anchor arm 602. As such, the radial gap 608 may be larger than a radial width 610 of the weighted feature 208, such that the weighted feature 208 has sufficient space to rotate around the anchor arm 602.

Moreover, the anchor arm 602 may include a first interlocking feature 612 at a distal end 614 of the anchor arm 602. In the illustrated embodiment, the distal end 614 of the anchor arm 602 extends past the first axial end 314 of the gun body 134. Alternatively, the distal end 614 of the anchor arm 602 may be disposed between the first axial end 320 of the charge tube 132 and the first axial end 314 of the gun body 134. The first interlocking feature 612 may include a spline (e.g., male spline or female spline) having ridges, teeth, and/or grooves. However, the first interlocking feature 612 may include any suitable interlocking feature for interfacing with a corresponding interlocking feature (e.g., a second interlocking feature 616) to lock rotational motion and permit axial motion between the corresponding interlocking features.

The perforating gun system 112 also includes the adjustment arm 600 that has the second interlocking feature 616 at a proximal end 618 of the adjustment arm 600. The second interlocking feature 616 may include a spline (e.g., female spline or male spline) configured to interface/interlock with the first interlocking feature 612 at one of a plurality of angular orientations with respect to the charge tube 132. Moreover, the adjustment arm 600 may include a handle 620 at a distal end 622 of the adjustment arm 600. The handle 620 may be position outside of the gun body 134 proximate the first axial end 314 of the gun body 134. However, in some embodiments, the handle 620 may be positioned within the gun body 134 between the first axial end 320 of the charge tube 132 and the first axial end 314 of the gun body 134. Exerting an axial force on the handle 620 in the axial outward direction 414 (e.g., direction axially away from the charge tube 132) may disengage the second interlocking feature 616 from the first interlocking feature 612, such that the adjustment arm 600 may rotate (e.g., adjust an angular orientation) with respect to the anchor arm 602 and the charge tube 132. Exerting an axial force in the axial inward direction 416 (e.g., direction axially toward the charge tube 132) may re-engage the second interlocking feature 616 with the first interlocking feature 612 to lock rotational movement of the adjustment arm 600 with respect to the anchor arm 602 and the charge tube 132.

Further, the perforating gun system 112 includes the weighted feature 208 rigidly secured to the adjustment arm 600, such that an angular orientation 212 of the weighted feature 208 with respect to the charge tube 132 is based at least in part on the angular orientation of the adjustment arm 600 with respect to the anchor arm 602. That is, the weighted feature 208 is configured to rotate about the anchor arm 602 in response to rotation of the adjustment arm 600 with respect to the anchor arm 602. In some embodiments, the weighted feature 208 may be directly attached to the adjustment arm 600. However, in the illustrated embodiment, the perforating gun system 112 includes a retainer 624 configured to rigidly secure the weighted feature 208 to the adjustment arm 600. The retainer 624 includes a first end 626 that is rigidly coupled to the adjustment arm 600. The first end 626 may be coupled to a portion of the adjustment arm 600 between the second interlocking feature 616 and the handle 620. A second end 628 of the retainer 624 may be coupled to the weighted feature 208. The retainer 624 may extend from the first end 626 to the second end 628 in the axial inward direction 416 (e.g., direction axially toward the first axial end of the charge tube 132) such that the second end 628 is axially aligned with at least a portion of the anchor arm 602. Aligning the second end 628 with the anchor arm 602 may axially align the weighted feature 208 with the anchor arm 602 such that the weighted feature 208 rotates about the anchor arm 602. Further, aligning the second end with the anchor arm 602 may position the weighted feature 208 within the gun body 134 between the first axial end 320 of the charge tube 132 and the first axial end 314 of the gun body 134.

In some embodiments, the perforating gun system 112 further includes a spring feature 630 disposed between the weighted feature 208 and the first axial end 314 of the gun body 134. The spring feature 630 may be a compression spring configured to bias the weighted feature 208 away from the first axial end 314 of the gun body 134 in the axial inward direction 416. However, any suitable spring feature 630 may be used to bias the weighted feature 208 in the axial inward direction 416. The spring feature 630 may be configured to provide the axial force in the direction axially toward the charge tube 132 (e.g., the axial inward direction 416) to re-engage the second interlocking feature 616 with the first interlocking feature 612 to lock rotational movement of the adjustment arm 600 with respect to the anchor arm 602 and the charge tube 132. Further, the spring feature 630 may continually bias the adjustment arm 600, via the weighted feature 208 and the retainer 624, in the direction axially toward the charge tube 132 to keep the second interlocking feature 616 axially engaged with the first interlocking feature 612 during operation of the perforating gun system 112.

As set forth above, the perforating gun system 112 may be configured to adjust the angular orientation 212 of the weighted feature 208 with respect to a charge tube 132 to adjust the center of gravity 138 of the charge tube 132, which adjusts the resting orientation of the charge tube 132; thereby, adjusting the aimed direction of the shaped charges 120. To adjust the angular orientation 212 of the weighted feature 208 in the illustrated embodiment, an operator may pull on the handle 620 to exert the axial force (i.e., greater than the biasing force from the spring feature 630) on the adjustment arm 600 in the axial outward direction 414 (e.g., direction axially away from the charge tube 132), which moves the adjustment arm 600 axially away from the anchor arm 602 and disengages the second interlocking feature 616 from the first interlocking feature 612. While disengaged, the operator may rotate the adjustment arm 600, via the handle 620, to a desired angular orientation 212 for the weighted feature 208 with respect to the charge tube 132. As set forth above, rotating the adjustment arm 600 rotates the weighted feature 208 about the anchor arm 602 due to the rigid connection of the weighted feature 208 to the adjustment arm 600 via the retainer 624. Once the weighted feature 208 is disposed at the desired orientation, the operator may release the handle 620 such that the biasing force from the spring moves the adjustment arm 600 axially toward the charge tube 132 and re-engages the second interlocking feature 616 with the first interlocking feature 612.

Accordingly, the present disclosure provides various systems configured to adjust an angular orientation 212 or radial position of a weighted feature 208 with respect to a charge tube 132 to adjust the center of gravity 138 of the charge tube 132; thereby, adjusting a resting orientation of the charge tube 132 to aim shaped charges 120 in the wellbore 114. In addition to the systems described above, additional systems having ratchet devices, slide locks, collet devices, etc. may also be used to adjust the angular orientation or radial position of the weighted feature 208. The systems may include any of the various features disclosed herein, including one or more of the following statements.

Statement 1. A perforating gun system, comprising: a gun body; a charge tube disposed within and rotatably mounted to the gun body, wherein the charge tube includes a receiving feature disposed at an axial end of the charge tube; at least one charge mounted within the charge tube, wherein the at least one charge is configured to perforate a sidewall of a wellbore upon detonation; and a weighted feature adjustably attached to the receiving feature of the charge tube in one of a plurality of angular positions, wherein adjusting the angular position of the weighted feature is configured to adjust a center of gravity of the charge tube such that gravity will cause the charge tube to rotate to a corresponding phasing angle.

Statement 2. The system of statement 1, wherein the weighted feature is disposed between the axial end of the charge tube and an axial end of the gun body.

Statement 3. The system of statement 1, further comprising an attachment feature mounted to the weighted feature and configured to interface with the receiving feature, wherein the weighted feature is adjustably attached to the receiving feature via the attachment feature.

Statement 4. The system of statement 3, the attachment feature is configured to adjust the angular position of the weighted feature with respect to the charge tube while the charge tube is disposed within and rotatably mounted to the gun body.

Statement 5. The system of statement 3, wherein the attachment feature is accessible and adjustable from an axial end of the gun body.

Statement 6. The system of statement 3, wherein the attachment feature comprises a plurality of pins mounted to an axial end of the weighted feature, and wherein the receiving feature comprises a plurality of corresponding slots disposed in an axial end of the charge tube, wherein each of the plurality of pins are configured to interface with each of the plurality of slots.

Statement 7. The system of statement 6, wherein the plurality of pins are configured to snap-fit to the plurality of corresponding slots.

Statement 8. The system of statement 3, wherein the attachment feature comprises a housing configured to mount to the receiving feature and house the weighted feature Statement 9. The system of statement 1, wherein a center of mass of the weighted feature is radially offset from a central axis of the charge tube.

Statement 10. The system of statement 1, wherein the weighted feature comprises a semi-cylinder shape.

Statement 11. A perforating gun system, comprising: a gun body; a charge tube disposed within and rotatably mounted to the gun body, wherein the charge tube includes a plurality of receiving holes disposed at an axial end of the charge tube; at least one charge mounted within the charge tube, wherein the at least one charge is configured to perforate a sidewall of a wellbore upon detonation; a compliant housing having a plurality of pins disposed at a first end and a flexible portion disposed at a second end, wherein the flexible portion is configured to deflect to retract the plurality of pins with respect to the charge tube and to release to insert the plurality of pins into a set of the receiving holes corresponding to an angular orientation of the compliant housing with respect to the charge tube; and a weighted feature configured to adjust a center of gravity of the charge tube such that gravity will cause the charge tube to rotate to a corresponding phasing angle, wherein the weighted feature is secured to the compliant housing and configured to adjust the center of gravity of the charge tube based on the angular orientation of the compliant housing with respect to the charge tube.

Statement 12. The system of statement 11, wherein the plurality of pins extend from the compliant housing in a radially outward direction with respect to the central axis of the charge tube.

Statement 13. The system of statement 11, wherein the compliant housing is disposed between the axial end of the charge tube and an axial end of the gun body.

Statement 14. The system of statement 11, wherein the charge tube comprises a plurality of sets of receiving holes each corresponding to respective angular orientations of the compliant housing with respect to the charge tube.

Statement 15. The system of statement 11, and wherein the flexible portion is accessible via the axial end of the gun body such that the flexible portion may be deflected while the charge tube is disposed within the gun body to adjust the angular orientation of the compliant housing with respect to the charge tube.

Statement 16. A perforating gun system, comprising: a gun body; a charge tube disposed within and rotatably mounted to the gun body; at least one charge mounted within the charge tube, wherein the at least one charge is configured to perforate a sidewall of a wellbore upon detonation; an anchor arm extending out from a first axial end of the charge tube, wherein a distal end of the anchor arm comprises a first interlocking feature; an adjustment arm comprising a second interlocking feature configured to interlock with the first interlocking feature at one of a plurality of angular orientations, wherein the adjustment arm is accessible at an axial end of the gun body for disengagement and re-engagement of the adjustment arm with respect to the anchor arm to change the angular orientation of the adjustment arm with respect to the anchor arm; a weighted feature rigidly secured to the adjustment arm, wherein an orientation of the weighted feature with respect to the charge tube is based at least in part on the angular orientation of the adjustment arm with respect to the anchor arm, and wherein changing the orientation of the weighted feature with respect to the charge tube is configured to adjust a center of gravity of the charge tube such that gravity will cause the charge tube to rotate to a corresponding phasing angle.

Statement 17. The system of statement 16, wherein the anchor arm is disposed within the gun body between the axial end of the charge tube and an axial end of the gun body.

Statement 18. The system of statement 16, further comprising a retainer configured to rigidly secure the weighted feature to the adjustment arm, the retainer having a first end rigidly coupled to the adjustment arm and a second end coupled to the weighted feature, wherein the second end axially aligned with at least a portion of the anchor arm.

Statement 19. The system of statement 16, wherein the first interlocking feature comprises a spline interface having a plurality of ridges or teeth configured to mesh with corresponding grooves of the second interlocking feature.

Statement 20. The system of statement 16, further comprising a spring feature configured to bias the adjustment arm toward the anchor arm to secure the second interlocking feature against the first interlocking feature during operation of the perforating gun system.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A perforating gun system, comprising:

a gun body;

a charge tube disposed within and rotatably mounted to the gun body, wherein the charge tube includes a receiving feature disposed at an axial end of the charge tube;

at least one charge mounted within the charge tube, wherein the at least one charge is configured to perforate a sidewall of a wellbore upon detonation; and a weighted feature adjustably attached to the receiving feature of the charge tube in one of a plurality of angular positions, wherein adjusting the angular position of the weighted feature is configured to adjust a center of gravity of the charge tube such that gravity will cause the charge tube to rotate to a corresponding phasing angle.

2. The system of claim 1, wherein the weighted feature is disposed between the axial end of the charge tube and an axial end of the gun body.

3. The system of claim 1, further comprising an attachment feature mounted to the weighted feature and configured to interface with the receiving feature, wherein the weighted feature is adjustably attached to the receiving feature via the attachment feature.

4. The system of claim 3, the attachment feature is configured to adjust the angular position of the weighted feature with respect to the charge tube while the charge tube is disposed within and rotatably mounted to the gun body.

5. The system of claim 3, wherein the attachment feature is accessible and adjustable from an axial end of the gun body.

6. The system of claim 3, wherein the attachment feature comprises a plurality of pins mounted to an axial end of the weighted feature, and wherein the receiving feature comprises a plurality of corresponding slots disposed in an axial end of the charge tube, wherein each of the plurality of pins are configured to interface with each of the plurality of slots.

7. The system of claim 6, wherein the plurality of pins are configured to snap-fit to the plurality of corresponding slots.

8. The system of claim 3, wherein the attachment feature comprises a housing configured to mount to the receiving feature and house the weighted feature.

9. The system of claim 1, wherein a center of mass of the weighted feature is radially offset from a central axis of the charge tube.

10. The system of claim 1, wherein the weighted feature comprises a semi-cylinder shape.

11. A perforating gun system, comprising:

a gun body;

a charge tube disposed within and rotatably mounted to the gun body, wherein the charge tube includes a plurality of receiving holes disposed at an axial end of the charge tube;

at least one charge mounted within the charge tube, wherein the at least one charge is configured to perforate a sidewall of a wellbore upon detonation;

a compliant housing having a plurality of pins disposed at a first end and a flexible portion disposed at a second end, wherein the flexible portion is configured to deflect to retract the plurality of pins with respect to the charge tube and to release to insert the plurality of pins into a set of the receiving holes corresponding to an angular orientation of the compliant housing with respect to the charge tube; and a weighted feature configured to adjust a center of gravity of the charge tube such that gravity will cause the charge tube to rotate to a corresponding phasing angle, wherein the weighted feature is secured to the compliant housing and configured to adjust the center of gravity of the charge tube based on the angular orientation of the compliant housing with respect to the charge tube.

12. The system of claim 11, wherein the plurality of pins extend from the compliant housing in a radially outward direction with respect to the central axis of the charge tube.

13. The system of claim 11, wherein the compliant housing is disposed between the axial end of the charge tube and an axial end of the gun body.

14. The system of claim 11, wherein the charge tube comprises a plurality of sets of receiving holes each corresponding to respective angular orientations of the compliant housing with respect to the charge tube.

15. The system of claim 11, and wherein the flexible portion is accessible via the axial end of the gun body such that the flexible portion may be deflected while the charge tube is disposed within the gun body to adjust the angular orientation of the compliant housing with respect to the charge tube.

16. A perforating gun system, comprising:

a gun body;

a charge tube disposed within and rotatably mounted to the gun body;

at least one charge mounted within the charge tube, wherein the at least one charge is configured to perforate a sidewall of a wellbore upon detonation;

an anchor arm extending out from a first axial end of the charge tube, wherein a distal end of the anchor arm comprises a first interlocking feature;

an adjustment arm comprising a second interlocking feature configured to interlock with the first interlocking feature at one of a plurality of angular orientations, wherein the adjustment arm is accessible at an axial end of the gun body for disengagement and re-engagement of the adjustment arm with respect to the anchor arm to change the angular orientation of the adjustment arm with respect to the anchor arm;

a weighted feature rigidly secured to the adjustment arm, wherein an orientation of the weighted feature with respect to the charge tube is based at least in part on the angular orientation of the adjustment arm with respect to the anchor arm, and wherein changing the orientation of the weighted feature with respect to the charge tube is configured to adjust a center of gravity of the charge tube such that gravity will cause the charge tube to rotate to a corresponding phasing angle.

17. The system of claim 16, wherein the anchor arm is disposed within the gun body between the axial end of the charge tube and an axial end of the gun body.

18. The system of claim 16, further comprising a retainer configured to rigidly secure the weighted feature to the adjustment arm, the retainer having a first end rigidly coupled to the adjustment arm and a second end coupled to the weighted feature, wherein the second end axially aligned with at least a portion of the anchor arm.

19. The system of claim 16, wherein the first interlocking feature comprises a spline interface having a plurality of ridges or teeth configured to mesh with corresponding grooves of the second interlocking feature.

20. The system of claim 16, further comprising a spring feature configured to bias the adjustment arm toward the anchor arm to secure the second interlocking feature against the first interlocking feature during operation of the perforating gun system.

* * * * *